US005257729A

United States Patent [19]

Silvernail

[11] Patent Number: 5,257,729

[45] Date of Patent: Nov. 2, 1993

[54] TOOL HOLDER

[76] Inventor: Mark C. Silvernail, 3645 Perry Ave. North, Robinsdale, Minn. 55422

[21] Appl. No.: 950,309

[22] Filed: Sep. 24, 1992

[51] Int. Cl.[5] ..... A45C 13/30

[52] U.S. Cl. ..... 224/219; 224/222; 224/236; 33/760; 33/768

[58] Field of Search ..... 224/219, 220, 221, 222, 224/236, 250, 251, 267, 904, 901; 33/712, 760, 761, 768, 770

[56] References Cited

U.S. PATENT DOCUMENTS

| | | | |
|---|---|---|---|
| 753,457 | 3/1904 | Weissbrod | 224/219 |
| 4,135,653 | 1/1979 | Sieloff | 224/222 |
| 5,009,347 | 4/1991 | Phelps | 224/219 |

*Primary Examiner*—Henry J. Recla
*Assistant Examiner*—David J. Walczak
*Attorney, Agent, or Firm*—Jacobson & Johnson

[57] ABSTRACT

A tool holder to enable a user to carry a tool proximate a user's wrist comprising: a flexible wrist strap having a first end, an intermediate portion and a second end, with the first end having a plurality of hook-like members and the second end having a plurality of loop-like members to enable the flexible wrist strap to be secured around a user's wrist by wrapping the flexible wrist strap around a user's wrist and then securing the flexible wrist strap around a user's wrist by engaging the hook-like members with the loop-like members with the flexible wrist strap having sufficient width so as to distribute forces around an extended region around a user's wrist to thereby prevent rotating of the flexible wrist strap around a user's wrist and a pouch secured to the intermediate portion of the flexible wrist strap, with the pouch having a compartment for holding a tool therein and an opening therein to permit extension of a portion of a tool therefrom without removing the tool from the pouch to enable a user to work the tool without having to grasp the tool in both hands.

9 Claims, 1 Drawing Sheet

TOOL HOLDER

FIELD OF THE INVENTION

This invention relates generally to a tool carrying device, and more specifically to the means and methods of securing hand manipulated tools in close proximity to user's hand, and to a fastener member for the tool carrying device which permits conformity and attachment of the tool carrying device to various wrist sizes.

BACKGROUND OF THE INVENTION

The concept of carrying tools such as tape measures has most frequently been done by the use of a tool belt or belt clip which allows a user, with a free hand, to access the tool. Typically, the tool has been stored on user's belt or tool pouch. The use of a tool requires freeing a hand to retrieve it, operate it, and replace the tool on the tool belt. This retrieval and replacement of the tool may be impossible or it may be distracting or dangerous, especially if the user is on a high ladder or scaffolding.

In some instances, the use of the tool may not be possible if the user cannot free a hand to retrieve it. In other instances, the use of a tool requires a user to set down other articles in the user's hand before the user can use the tool.

The present invention allows a user to have the tool in close proximity to his or her hand at all times, without the tool interfering with other tasks. That is, the tool is held securely to the user's wrist by means of a strap and pouch assembly. The invention permits the user to access and use the tool without removal of the tool from the pouch.

The advantage of this invention is, also, that the user has the tool with him or her at his or her immediate work area. There is no time lost retrieving the tool from another part of the work site. That is, wherever the user goes, the tool is with him or her, and immediately accessible.

SUMMARY OF THE INVENTION

Briefly, the invention comprises a tool holder for securing a frequently accessed tool, such as a tape measure, to a user's wrist. The tool holder has a pouch that holds the tape measure, a strap attached to the pouch has loop type fasteners on opposite ends, which are wrapped around the user's wrist to hold the strap in place. The pouch has access holes that allow extension and retraction of a tape measure blade so that the tape measure can be used while still attached to the user's wrist. That is, negating the need to remove the tape measure from the pouch before using it.

DESCRIPTION OF THE PREFERRED EMBODIMENT

Figure 1:
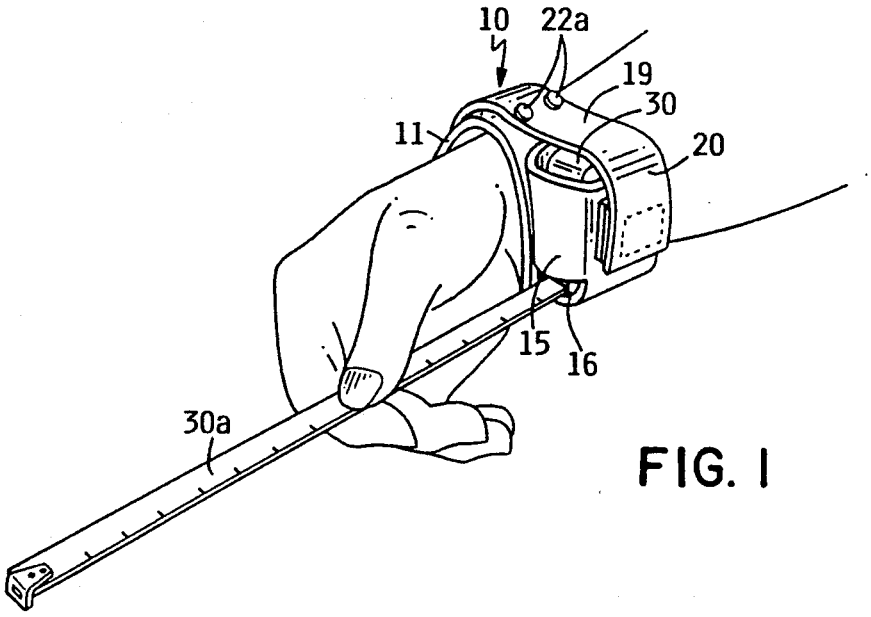
FIG. 1 is a perspective view of a tool holder in use and attached to a user's wrist.
Figure 2:
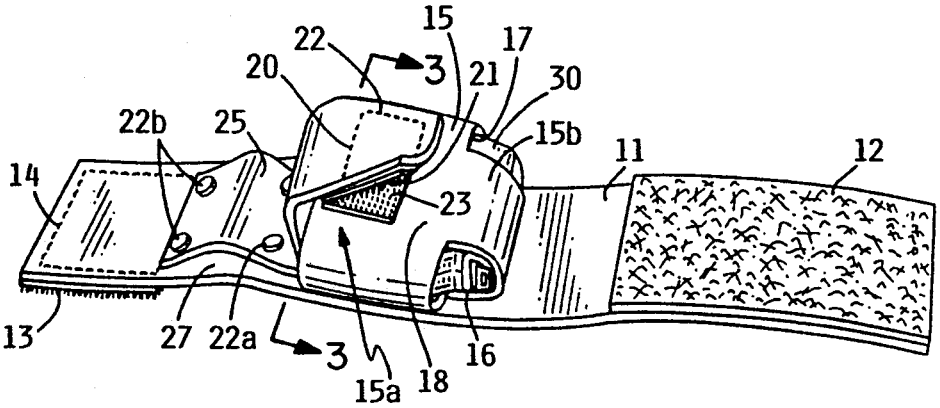
FIG. 2 is a perspective view of an unattached tool holder having pouch, strap, pencil holder and fasteners.

Referring to FIG. 1, reference numeral 10 generally identifies a tool holder assembly having a flexible wrist strap 11 for securing firmly about a user's wrist. Wrist strap 11 is preferably made of flexible material such as nylon or leather. Wrist strap 11 has a tool pouch 15 securely fastened thereto by rivets 31 and 32 (FIG. 2). Pouch 15 holds a retractable tape measure 30 therein by both friction from inner walls of pouch 15 and by a cover 20 secured by hook and loop fasteners 23 and 21.

FIG. 1 shows tape measure extendable blade 30*a* extending through an access hole 16 in pouch 15. Opening 16 is sufficiently large to permit free extension and retraction of blade 30*a* through opening 16 without removing tape measure 30 from pouch 15.

FIG. 2 shows the tool holder unattached from the user's wrist. Wrist strap 11 has two ends and an intermediate portion with loop type fasteners 12 stitched to one end of strap 11 and on the opposite end and reverse face of wrist strap 11 hook type fasteners 13 stitched to strap member 11 by stitches 14. Loop type fasteners 12 and hook type fasteners 13 cooperate to fasten securely to each other. Loop and hook fasteners are well known in the art and are sold under the trademark VELCRO. Loop type fasteners 12 extends along wrist strap 11 such that wrist strap 11 coacts with hook fastener 13 to accommodate different wrist sizes.

Loop and hook type fasteners mentioned herewithin can be substituted with alternate fastening members located at the same positions. Alternate fastening members are, but not limited to, snaps, or the like.

Figure 3:
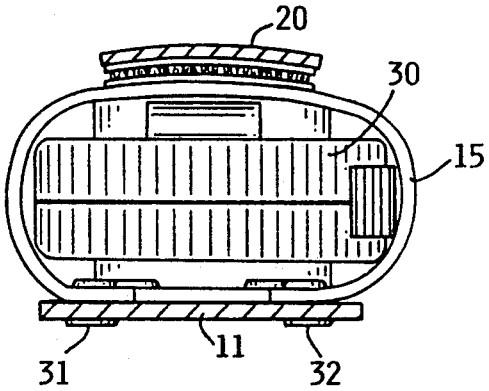
FIG. 3 is a cross sectional view of FIG. 2 from reference lines 3—3.

The intermediate section of wrist strap 11 includes a pencil holder 25 and pouch 15 which is secured thereupon by rivets 31 and 32 (FIG. 3). Pencil holder 25 being a part of a strap 19 that forms both a pencil holder and a pouch cover 20. Pouch cover 20 comprises an elongated transverse opening 27 between strap 11 and strap 19. Opening 27 is sufficiently small to frictionally hold a common pencil and allow for its removal and replacement from either end of opening 27.

FIG. 3 also shows pouch 15 being securely fastened to wrist strap 11 by means of rivets 31 and 32. In the embodiment shown, pouch 15 comprises a looped strap 18 which fastens transverse to strap 11.

The front face of pouch 15 has a top end 15*a* that includes looped fasteners 23 stitched thereon for securing hook fasteners 21 of cover 20 thereto.

Bottom 15*b* of pouch member 15 has two identical openings, 16 and 17, allowing tape measure 30*a* to extend and retract freely from either end, thus allowing tool holder 10 to be usable on either wrist. That is, tape measure 30 may be removed from pouch 15 and replaced in a reverse fashion so to allow the user to switch the tool holder to another wrist or to put the tool holder on the outside of the wrist.

In operation of the invention, the invention is strapped to the user's wrist by wrapping strap 11 around the wrist and securing the strap around the wrist with hook fasteners 12 and loop fasteners 13. Once in place, the tape measure blade 30*a* can be extended and retracted at the user's convenience. A situation example is a user with a clip board in one hand and a need to measure and write down the measurements. The user, while holding the clipboard in one hand, can easily extend blade 30*a*, measure with it, replace it, and record the data without the need to set down the clip board or reach into his or her pocket for the tape measure.

While the drawings show a tape measure other tools can be used with the invention. For example, tools such as chalk lines and tape dispensers, or materials such as coiled wire, tape, and other materials that unroll from their package are suitable for use with the present invention.

I claim:

1. In combination, a tool holder to enable a user to carry a tape measure proximate the user's wrist and to permit on-the-go intermittent use of the tape measure while the tape measure remains in the tool holder comprising:

a tape measure having an extendable and retractable blade for use in measuring distances;

a flexible wrist strap having a first end and an intermediate portion and a second end, said first end having a plurality of hook-like members, said second end having a plurality of loop-like members extending continuously along a portion of said second end to enable said flexible strap to be adjustably secured around a user's wrist by wrapping said flexible wrist strap around the user's wrist and then securing the flexible wrist strap around the user's wrist by engaging the hook-like members on said first end with a portion of the loop-like members on said second end in accordance with the size of the user's wrist, said flexible wrist strap having sufficient width so as to distribute forces around an extended region around the user's wrist to thereby prevent rotation of said flexible wrist strap around the user's wrist; and a tape measure pouch secured to said intermediate portion of said flexible wrist strap, said tape measure pouch having a compartment for holding the tape measure with an extendable and retractable blade therein, said pouch having a first side, a second side, a first end, and a second end, said first end of said pouch having an opening for insertion of the tape measure with a laterally extendable and retractable blade therein, said second end of said pouch having an opening to permit extension and retraction of the laterally extendable and retractable blade when the tape measure is positioned in said pouch without having to remove the tape measure from said pouch; and a cover for holding the tape measure in the compartment in said pouch, said cover extending over said opening for insertion of said tape measure, said cover having a first end secured to said flexible wrist strap and a second end releasably secured to said pouch to permit insert or removal of the tape measure, yet prevent the tape measure inside the pouch from falling out of the pouch when the user is performing work to thereby permit the user to maintain the tape measure in a ready to use condition proximate the user's hand.

2. The tool holder of claim 1 including a pencil holder located on said intermediate portion.

3. The tool holder of claim 2 wherein said pencil holder comprises a flexible strap secured to said intermediate portion.

4. The tool holder of claim 1 including wherein said tool holder is made of leather and said pouch is fastened to said strap by rivets.

5. The tool holder of claim 1 wherein said tool holder is made of nylon.

6. The tool holder of claim 1 wherein said cover includes hook-type member and said pouch includes loop-type members for securing said cover over the tape measure located on said pouch.

7. The tool holder of claim 1 wherein said loop members and said hook members extend over an extended area to permit said flexible wrist strap to fit around various wrist sizes.

8. The tool holder of claim 1 wherein said flexible strap has a minimum width of approximately 1½ inches.

9. A tool holder to enable a user to carry a tool proximate the user's wrist and to permit on-the-go intermittent use of the tool while the tool remains in the tool holder comprising:

a flexible wrist strap having a first end and an intermediate portion and a second end, said first end having a plurality of hook-like members, said second end having a plurality of loop-like members extending continuously along a portion of said second end to enable said flexible strap to be adjustably secured around a user's wrist by wrapping said flexible strap around the user's wrist and then securing the flexible wrist strap around the user's wrist by engaging the hook-like members on said first end with a portion of the loop-like members on said second end in accordance with the size of the user's wrist, said flexible wrist strap having sufficient width so as to distribute forces around an extended region around the user's wrist to thereby prevent rotation of said flexible wrist strap around the user's wrist; and a tool pouch secured to said intermediate portion of said flexible wrist strap, said tool pouch having a compartment for holding a tool and permitting access to the tool therein, said pouch having a first side, a second side, a first end, and a second end, said first end of said pouch having an opening which faces one of said strap first or second ends when said strap is in an unfolded position for insertion of a tool, said second end having an opening to permit use of the tool when the tool is positioned in said pouch without having to remove the tool from said pouch; and a cover for holding the tool in the pouch, said cover extending over said opening for insertion of a tool in said compartment, said cover having a first end secured to said flexible wrist strap and a second end secured to said pouch to hold the tool inside the compartment when the user is performing work to permit the user to maintain the tool in a ready to use condition inside the compartment.

* * * * *